US006638384B1

(12) United States Patent
Edwards et al.

(10) Patent No.: US 6,638,384 B1
(45) Date of Patent: Oct. 28, 2003

(54) METHOD AND APPARATUS FOR MAKING BRISTLE SUBASSEMBLIES

(75) Inventors: Mark Stephen Edwards, Hockessin, DE (US); Harold Francis Staunton, Avondale, PA (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/550,657

(22) Filed: Apr. 17, 2000

Related U.S. Application Data

(60) Provisional application No. 60/130,883, filed on Apr. 23, 1999.

(51) Int. Cl.[7] ..... B65H 81/00

(52) U.S. Cl. ..... 156/173; 156/73.2; 156/435

(58) Field of Search ..... 156/173, 174, 156/175, 72, 435, 73.2, 166, 168, 169, 180, 429, 430, 431

(56) References Cited

U.S. PATENT DOCUMENTS

| | | | | |
|---|---|---|---|---|
| 3,107,124 A | | 10/1963 | Barr | 300/21 |
| 3,726,751 A | | 4/1973 | Casadevall | 161/58 |
| 3,880,696 A | * | 4/1975 | Chen | 156/428 |
| 4,361,922 A | * | 12/1982 | Karal | 15/1.51 |
| 4,382,309 A | * | 5/1983 | Collis | 15/110 |
| 5,454,133 A | * | 10/1995 | Garnet | 15/106 |
| 5,470,629 A | | 11/1995 | Mokhtar et al. | 428/85 |
| 5,472,762 A | | 12/1995 | Edwards et al. | 428/93 |
| 5,498,459 A | | 3/1996 | Mokhtar et al. | 428/85 |
| 5,547,732 A | * | 8/1996 | Edwards et al. | 156/166 |
| 5,804,008 A | | 9/1998 | Kennard et al. | 156/72 |
| 5,987,688 A | * | 11/1999 | Roberts et al. | 15/110 |
| 6,260,229 B1 | * | 7/2001 | Edwards et al. | 15/207.2 |

FOREIGN PATENT DOCUMENTS

| | | |
|---|---|---|
| GB | 396730 | 8/1933 |
| WO | WO 94/19521 | 9/1994 |
| WO | WO 96/06965 | 3/1996 |
| WO | WO 97/06003 | 2/1997 |

OTHER PUBLICATIONS

PCT International Search Report dated Aug. 14, 2000.
U.S. patent application Ser. No. 09/092,094, Edwards et al., filed Jun. 5, 1998.
U.S. patent application Ser. No. 09/092,092, Edwards et al., filed Jun. 5, 1998.
U.S. patent application Ser. No. 09/247,093, Edwards et al., filed Feb. 9, 1999.

* cited by examiner

*Primary Examiner*—Jeff H. Aftergut
*Assistant Examiner*—John L. Goff

(57) ABSTRACT

A continuous method for making a polymeric bristle subassembly using a continuous moving cable support to move the filament wraps along the mandrel. The base string being bonded to the polymeric filaments of the wrap as the filament wraps are transported to form a bristle sub assembly.

An apparatus for making the subassemblies is also part of this invention. Other aspects of this invention are a continuous method of making a bristle subassembly wherein the base string is omitted and the filaments of the wrap are bonded to each other through the use of an energy source, or the use of a polymeric bead to bond the filaments together or use of a solvent or an adhesive to bond the polymeric filaments of the wrap together to form a bristle subassembly.

26 Claims, 6 Drawing Sheets

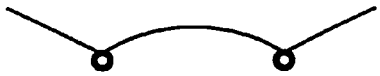
FIG. 10
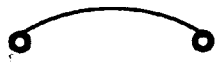
FIG. 11
FIG. 12
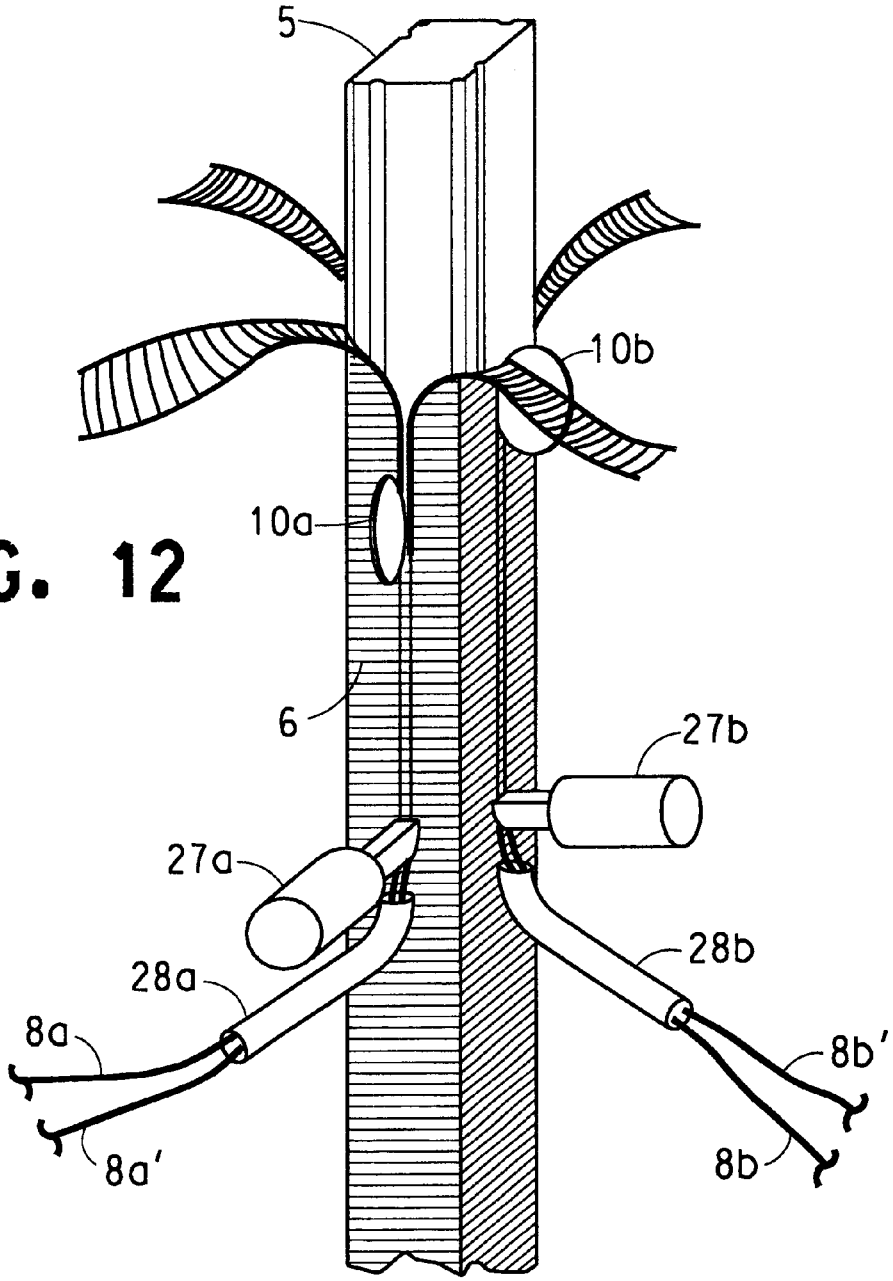

METHOD AND APPARATUS FOR MAKING BRISTLE SUBASSEMBLIES

This application claims the benefit of U.S. Provisional Application No. 60/130,883, filed Apr. 23, 1999.

FIELD OF THE INVENTION

This invention relates to a method and apparatus for making polymeric bristle subassemblies having a base string with polymeric filament bristles attached thereto and also to polymeric bristle subassemblies wherein the polymeric filament bristles are attached to each other without the presence of a base string.

BACKGROUND OF THE INVENTION

Various methods for making elongated pile articles having a support strand or base string with a plurality of yarn bundles attached thereto that are useful in making carpet are shown in Mokhtar et al U.S. Pat. No. 5,470,629 issued Nov. 28, 1995, Edwards et al U.S. Pat. No. 5,547,732 issued Aug. 20, 1996, Mokhtar et al U.S. Pat. No. 5,498,459 issued Mar. 12, 1996, Edwards et al U.S. Pat. No. 5,472,762 issued Dec. 5, 1995 and Agreen et al WO 97/06003 published Feb. 20, 1997. These processes require a base string or support strand of a polymeric filament to move the wrap of yarn or filament along a mandrel as it is being processed to form the article. In a preferred ultrasonic bonding method for assembling these articles, one limitation of the method is that the bonding device must deliver vibrational energy through the wrap of yarns or filaments to the contact interfaces with the support strand to generate heating and partial melting of the strand and/or wrap. However, since the mass cross-sections of the yarns or filaments of the wrap are commonly smaller than the support strand cross-section, the bonding energy delivered to the interface of the wrap and the support strand must be controlled precisely within a given bonding window to produce surface melting at the interface of the wrap and the support strand while avoiding sufficient bulk heating in the wrap of yarns or filaments to damage or sever them. A wrap of small diameter yarns or filaments may exhibit narrow or even a nonexistent bonding window that results in an unstable or unsatisfactory process. Another limitation of these processes is that the support strand must maintain sufficient strength during the partial melting in the bonding step to transport the article through the process. The support strand must have a large enough cross-section or have a sheath/core structure with a core of a significantly higher melting material that it will not break under the tension and melting which occur during the process.

A process and apparatus are needed in which the requirements of the support strand or base string are reduced allowing for the use of a variety of sizes and types of base strings to form bristle subassemblies.

SUMMARY OF THE INVENTION

A continuous method for making a polymeric bristle subassembly using the steps of (1) continuously forming a wrap of polymeric filaments by wrapping at least one filament around the axis of at least a three sided mandrel having a moving cable support on each corner running the length of the mandrel on the exterior corner of the mandrel capable of supporting and moving the polymeric filaments of the wrap along at least a portion of the length of the mandrel;

(2) feeding at least one base string outside of the wrap of polymeric filaments to a selected portion of the mandrel as required to form the subassembly, such as the corner or side of the mandrel, while the polymeric filaments of the wrap are being moved along at least a portion of the length of the mandrel;

(3) bonding the base string and the polymeric filaments of the wrap together by simultaneously pressing the base string in contact with the filaments of the wrap and applying energy to the base string and the polymeric filaments of the wrap; and (4) cutting the polymeric filaments of the wrap at a point downstream of where the polymeric filaments of the wrap are bonded with the base string to form at least one bristle subassembly having at least one row of filament segments connected to at least one base string.

An apparatus for making the subassemblies is also part of this invention. Other aspects of this invention are a continuous method of making a bristle subassembly wherein the base string is omitted and the filaments of the wrap are bonded to each other through the use of an energy source, or the use of a polymeric bead to bond the filaments together or use of a solvent or an adhesive to bond the polymeric filaments of the wrap together to form a bristle subassembly.

BRIEF DESCRIPTION OF THE DRAWINGS

FIG. 10 is a cross-section of a two base string bristle subassembly made by using a four sided mandrel and cut on two opposing sides of the mandrel.

FIG. 11 is a cross-section of another two base string bristle subassembly that uses adjacent pairs of base strings and is cut between the paired base strings using the process as shown in FIG. 12.

FIG. 12 is a schematic of the method using paired base strings.

DETAILED DESCRIPTION OF THE INVENTION

Figure 1:
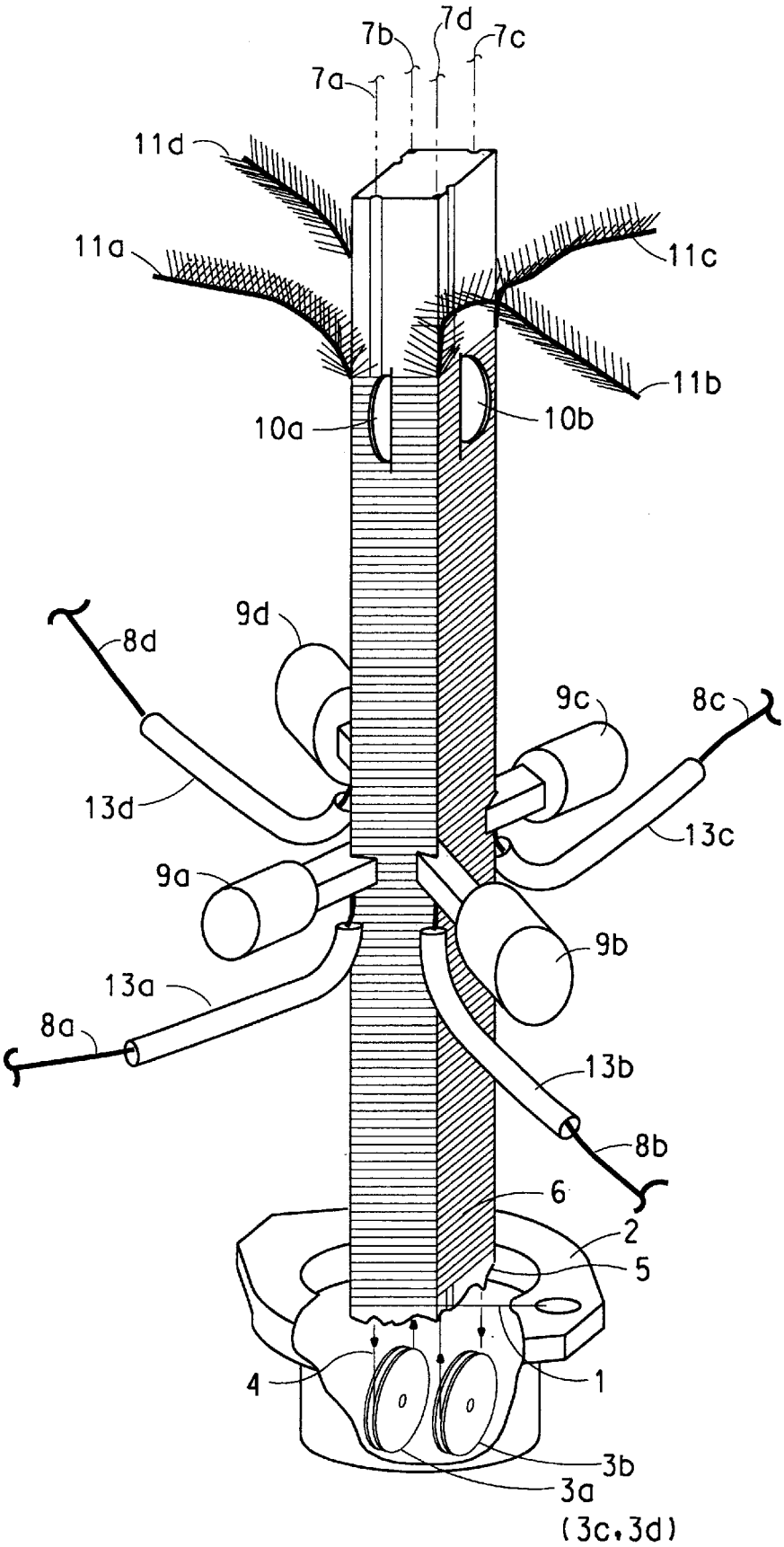
FIG. 1 is a schematic showing the method for forming a typical bristle subassembly.

This invention is directed to a continuous process for making bristle subassemblies by forming a wrap of polymeric filaments around a mandrel having at least three sides and preferably four sides. There is at least one moving cable support that moves the wrap of polymeric filaments along a substantial length of the mandrel; preferably one endless cable support is positioned on each corner of the mandrel. In the preferred embodiment of this invention, the endless cable support moves away from the wrapper mechanism, is positioned on each of the exterior corners of the mandrel and runs along the corner and returns by running down a recessed channel in a diagonal opposing face of the mandrel in the opposite direction. For a single base string bristle subassembly, at least one base string is fed outside of the wrap of polymeric filaments on either a side of the mandrel or on a corner of the mandrel. For alternative bristle subassemblies, there can be at least one base string positioned on at least one side of the mandrel. The number and position of the base string(s) depends on the type of bristle subassembly that is to be made. At the point just prior to the base string being bonded with the polymeric filaments of the wrap on the mandrel, the base string is maintained in direct contact with the filaments of the wrap while the filaments of the wrap are being moved along the length of the mandrel and the base string is bonded to the filaments of the wrap by applying energy to the base string, usually ultrasonic energy, to at least partially melt the base string and/or the filaments of the wrap. In one embodiment of this invention, the filaments of the wrap are then cut at a point down stream of where the base string is bonded to form a plurality of bristle subassemblies having two rows of filament segments connected to the base string. Other subassemblies can be made by the process of this invention as will be described hereinafter.

The filament used as the base string has a diameter of 50–5,000 microns and the filament used for the wrap has a diameter of 12–5,000 microns.

The base string may be a bundle of filaments wherein at least one filament of the bundle is a monofilament of a thermoplastic polymer and the remaining filaments can be of natural fibers such as cotton, jute, hemp and the like, or man made non-thermoplastic filaments, such fiberglass. Alternatively, the base string may be a bundle of natural fibers or non-thermoplastic filaments. Where the base strings are comprised of natural fibers or non-thermoplastic filaments, the filaments of the wrap must be made of a thermoplastic polymer for a bond to occur using thermal energy. The requirement for the filaments of the wrap to be of a thermoplastic polymer is eliminated when the means of bonding is an adhesive or application of a thermoplastic bead.

The base string and the polymeric filaments of the wrap usually are monofilaments of thermoplastic polymers. Typically useful thermoplastic polymers are aliphatic polyamides, aromatic polyamides, polyesters, polyolefins, polystyrenes, styrene copolymers, polyvinylchloride, fluoropolymers, polyurethanes or polyvinylidene chloride. Co-extrusions of the above polymers can be used to enhance the properties of the bristle subassembly by combining the individual properties of each of the polymers.

Polyamides, such as nylon 4, nylon 6, nylon 11, nylon 12, nylon 6,6, nylon 6,12, nylon 6,14, nylon 10,10 and nylon 12,12, are preferred for bristles used in brushes. For toothbrush bristle applications, nylon 6,12 (polyhexamethylene dodecane amide) is preferred since it has superior properties of flexibility, bend recovery and wear resistance.

Polyesters which have been found useful for bristle include polybutylene terephthalate and polyethylene terephthalate, of which the first is particularly preferred. Of the many polyolefins which can be used for bristle manufacture, polypropylene is better suited.

Typically, these monofilaments used for the wrap contain additives such as abrasives, colorants, light reflecting particles such as aluminum flake and cellophane, therapeutic agents, anti-microbial agents and mixtures thereof in amounts of 0–50% by weight, preferably 0.1–40% by weight, based on the weight of the monofilament. Typically useful abrasive particles are as follows: aluminum silicate, silicon carbide, aluminum oxide, alumina zirconia, silicon dioxide, sodium aluminum silicate, cubic boron nitride, garnet, pumice, emery, mica, quartz, diamond, boron carbide, fused alumina, sintered alumina, walnut shells and any mixtures thereof.

Flake particles can be added to the monofilament used for the wrap in amounts of 0.2–5.0% by weight, based on the weight of the monfilament. Preferred flake particles are flakes of aluminum and cellophane. Aluminum has excellent light reflecting properties, which improves its visibility in the filaments. It is inexpensive, widely available in film and flake form and is safe to use. Aluminum flake that is approved for food contact is preferred for use in toothbrushes. Aluminum and cellophane are not melted or destroyed in the processing steps used to form the filaments. Preferably, these flakes are formed by die cutting aluminum foil or cellophane sheets.

An apparatus for continuously making a bristle subassembly is also part of this invention. The apparatus comprises the following:

(1) a mandrel having at least three sides and having a moving cable support on each corner running at least a portion of the length of the mandrel on the exterior corners of the mandrel;

(2) a wrapping means for continuously wrapping a polymeric filament around the axis of the mandrel to form a wrap of filaments; where the wraps are supported and moved along at least a portion of the length of the mandrel by the cable support;

(3) a means for feeding at least one base string outside of the wrap of filaments to a selected portion of the mandrel as required to form the selected bristle subassembly while the wrap of polymeric filaments is being moved along at least a portion of the length of the mandrel by the cable support;

(4) a means for continuously bonding the base string and the polymeric filaments of the wrap together by simultaneously pressing the base string in contact with the filaments of the wrap and applying energy to the base string and the filament of the wrap; and (5) a means for cutting the wrap of polymeric filaments at a point downstream of where filaments of the wrap are bonded with the base string to form at least one bristle subassembly having at least one row of filament segments connected to at least one base string.

Preferably, the means for bonding the base string and polymeric filaments of the wrap together is a wave energy source from an ultrasonic horn that applies sufficient wave energy to partially melt at least one of the base string, the polymeric filaments of the wrap or both. The ultrasonic horn is positioned adjacent to the mandrel and defines an opening sufficient to allow passage of the base string and wrap of filaments and maintains the base string in contract with the wrap of filaments and does not allow the base string to reposition itself.

The following are preferred embodiments of the apparatus:

Endless cables are used to convey the wrap of filaments while being processed on the mandrel. The movement of each cable is synchronized to achieve the preferred normal angle between the wrap of filaments and the base string. The preferred cable construction is of 7×7 wire rope of diameters, 1/32, 3/64 or 1/16 inch. The 7×7 wire rope is easily spliced to form an endless cable with a uniform diameter and most importantly without surface variations which could cause a repeating defect in the bristle subassembly.

Additionally, the 7×7 construction has good flexibility allowing the use of small diameter pulleys at the bottom of the mandrel without a significant adverse effect on cable life. Other suitable materials for endless cables are large caliber monofilaments such as those used for Lawn and Garden string trimmers; and braided Kevlar® cord.

The wrapping means continuously forms a wrap by using at least one filament under controlled tension and rotates around the axis of the mandrel to form the wrap of filaments that are first brought into contact with an endless cable and then with the base string.

A base string is positioned on each corner of a four sided mandrel outside of the wrap of filaments and the endless cable support runs along one corner along the length of the mandrel protruding outward from the intersection of two side planes that form the corner of the mandrel and runs in an opposite direction in a recessed channel in the mandrel located on a diagonal side of the mandrel from the corner so as not to protrude into the plane of the mandrel side.

Alternatively, at least one, and preferably two base strings are positioned on each side of a four sided mandrel outside of the wrap of filaments and the endless cable support runs along each corner along the length of the mandrel and runs in an opposite direction in a recessed channel in the mandrel located on a diagonal side of the mandrel from said corner.

Following is a detailed description of FIGS. 1–12 to show the method, apparatus and resulting products of this invention:

FIG. 1 shows a schematic of a preferred embodiment of the process of this invention. Filament 1 is fed from a spool (not shown) through a tensioning drive (not shown) and is continuously wrapped around the four-sided mandrel 5 by a wrapping mechanism 2 to form a continuous wrap 6 on the mandrel 5. A high speed wrapping mechanism is used which is an improvement to the conventional wrapping mechanism U.S. Pat. No. 5,547,732, which is hereby incorporated by reference.

A cable, preferably an endless cable support 4 which can be a metal wire or a suitable polymeric cable runs down along groove 7*a* on the face of the mandrel and its direction is reversed by pulley 3*a* and the cable then runs up the corner 7*b* of the mandrel and moves the wrap 6 along the length of the mandrel 5. Cable 4 is redirected and runs down the back of the mandrel 5 in groove 7*c* and is redirected again by pulley 3*b* and runs up in the corner 7*d* of the mandrel and supports the wrap and moves the wrap along the length of the mandrel 5. Endless support cable 4*a* (not shown) is synchronized with cable 4 and is positioned similarly on the two remaining opposite corners of the mandrel and run in grooves on the opposite side of the mandrel. Pulleys (not shown) are required for the second endless cable to redirect and reverse the direction of the endless cable 4*a*.

Base strings 8*a*, 8*b*, 8*c*, and 8*d* are fed through corresponding guide tubes 13*a*, 13*b*, 13*c*, and 13*d* to each side of the mandrel 5, preferably to each corner of the mandrel 5 as shown in FIG. 1, and brought into contact with the wrap 6. Ultrasonic assemblies 9*a*, 9*b*, 9*c*, and 9*d* hold the base strings 8*a–d* in contact with the wrap 6 and provide sufficient energy to at least partially melt the base strings, the filaments of the wrap or both the base strings and the wrap and bond both together. Typically, 0.1–5.0 joule energy is used to bond a thermoplastic polyamide monofilament base string to the filaments of the wrap.

As the filaments of the wrap are bonded with the base string and proceed along the length of the mandrel 5, the filaments of the wrap are cut by cutters 10*a* and 10*b* into a plurality of bristle subassemblies 11*a*, 11*b*, 11*c* and 11*d*. Not shown are cutters on the opposite sides of the mandrel positioned opposite cutters 10*a* and 10*b*. The bristle subassemblies 11*a–d* are then wound on spools and are available for use in making articles such as brushes, particularly toothbrushes.

Figure 4:
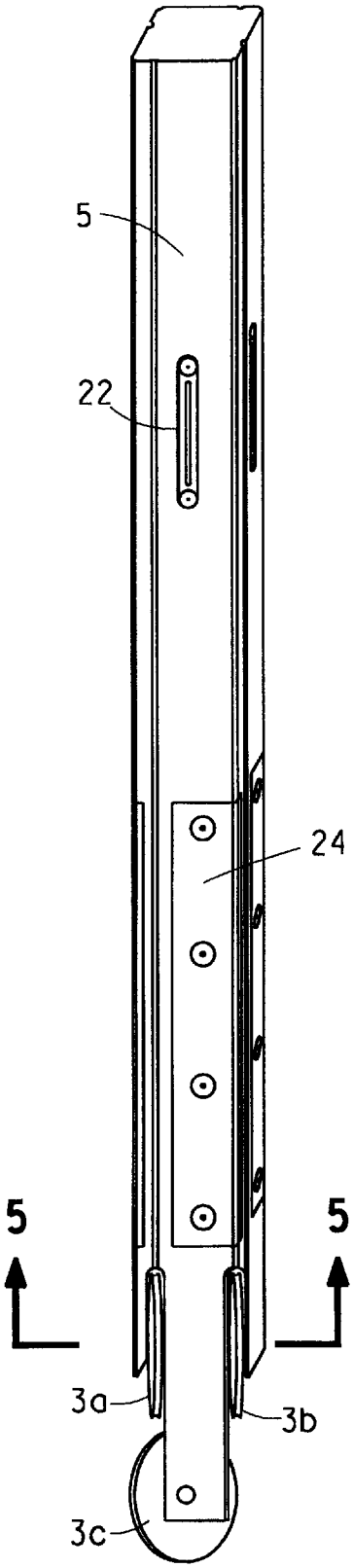
FIG. 4 is a detail of the mandrel.

FIG. 4 shows a groove 22 commonly referred to as a bed knife to assist the blade of the cutter. Each of the cutters is a rotating cutting blade and each blade intersects the bed knife in the side of the mandrel with about a 0.25 mm clearance on each side of the blade. The blades may be 0.8–1.6 mm thick with a sharp edge at the perimeter having an included angle of 20–45° and are made from a variety of materials such as ittria stabilized zirconia available from Ceramco, Inc., Center Conway, N.H.

Figure 2:
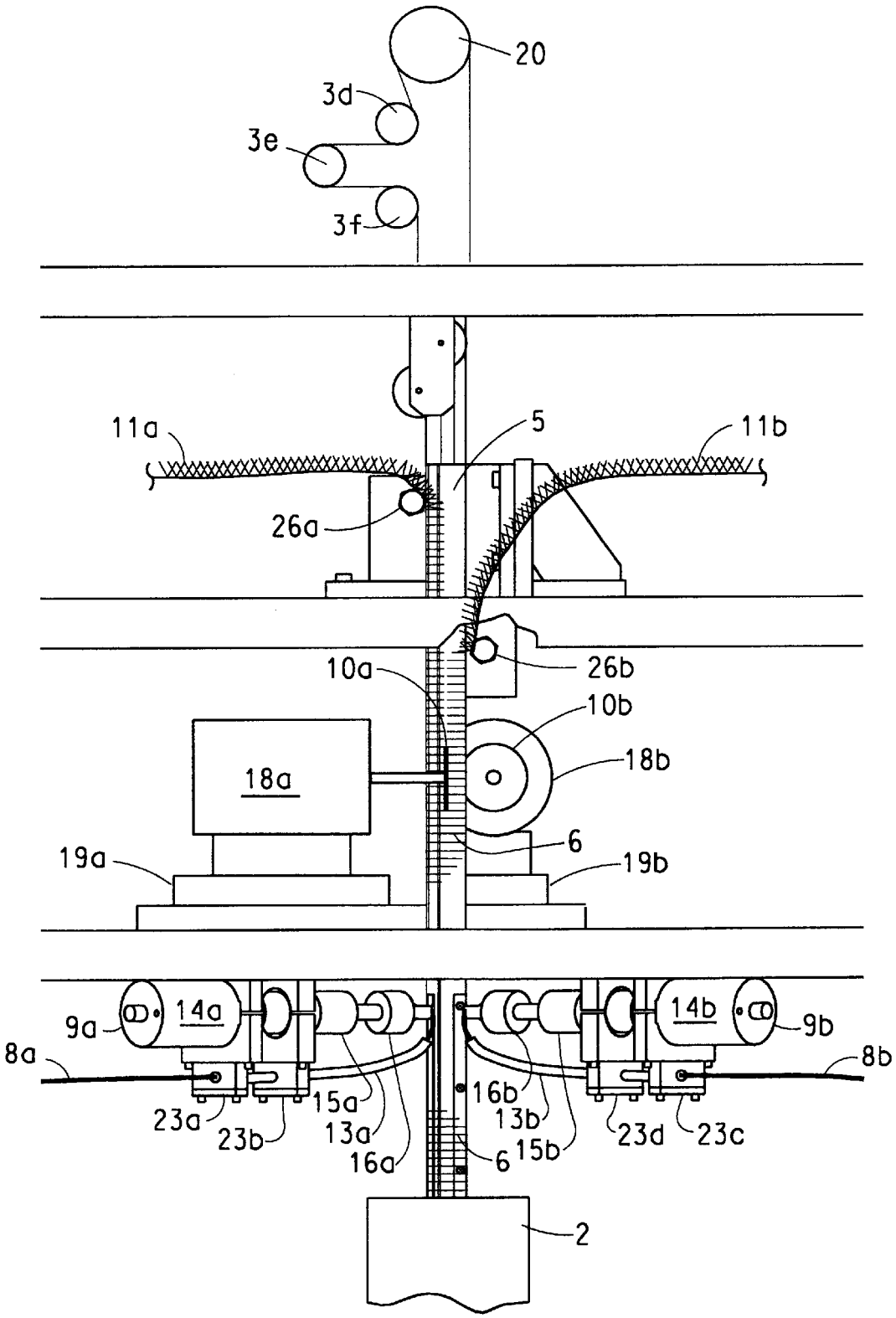
FIG. 2 is an elevation view of equipment for forming a typical bristle subassembly.

FIG. 2 is an elevation view of the equipment used to manufacture the bristle subassembly. The mandrel 5 is positioned so that the longitudinal centerline of the mandrel 5 is aligned with the centerline axis of the wrapper mechanism 2. Base strings 8*a* and 8*b* are fed through guide tubes 13*a*, 13*b* which are held in place by supports 23*a*, 23*b*, 23*c*, and 23*d*. Only two base strings 8*a* and 8*b* and the corresponding guide tubes are shown. The guide tubes are bent at the discharge end to gently transition the base strings from a horizontal to a vertical orientation. The angle between the mandrel and the base string leaving the guide tube is no more than 45° and preferably less than 30° to improve tracking of the base string into the interface of the ultrasonic horn and filament of the wrap.

The base strings 8*a* and 8*b* are drawn between the face of the ultrasonic horns 16*a* and 16*b* and the corner cables wrapped with the wrap 6 of polymeric filaments. Energy is transferred from the ultrasonic assemblies 9*a* and 9*b*, to the base strings 8*a* and 8*b* and the filaments of the wrap 6 by pressing the frontal contact surface of the vibrating horn tip against the base string as it and the filaments of the wrap are being transported past the vibrating horn tip.

Each ultrasonic assembly 9*a* and 9*b* is comprised of three major components. The ultrasonic transducers 14*a* and 14*b* convert electrical energy into longitudinal-mode mechanical energy (motion). Ultrasonic boosters 15*a* and 15*b* are mechanical amplifiers that either increase or decrease the amplitude of the longitudinal-mode vibrations. Properly configured horns 16*a* and 16*b* transfer the vibrational energy to the filaments as they pass by the horns. Ultrasonic assemblies 9*a* and 9*b* are held in place by supports 23*a–d*. A force is regulated to each horn assembly by pneumatic air cylinders (not shown) which creates a compression force (typically 2.2–22.0 kg) on the base string and the filaments of the wrap passing between the horn and mandrel.

Cutter assemblies 18*a* and 18*b* are mounted on movable bases 19*a* and 19*b* respectively, and cutters 10*a* and 10*b* slit the wrap bonded to the base string to form bristle subassemblies 11*a* and 11*b*. The bristle subassemblies 1*a* and 11*b* are passed over corresponding rollers 26*a* and 26*b* and then wound onto spools, not shown. The rollers are non-driven rotating cylinders that change the direction of the bristle subassembly from the vertical to the horizontal or to some other angle. Only two cylindrical rollers are required for the four bristle subassemblies and are positioned parallel to and with adequate spacing from the mandrel so that the vertical centerline of the approaching bristle subassembly is maintained parallel to the mandrel and against the endless cable traveling up the mandrel.

Figure 3:
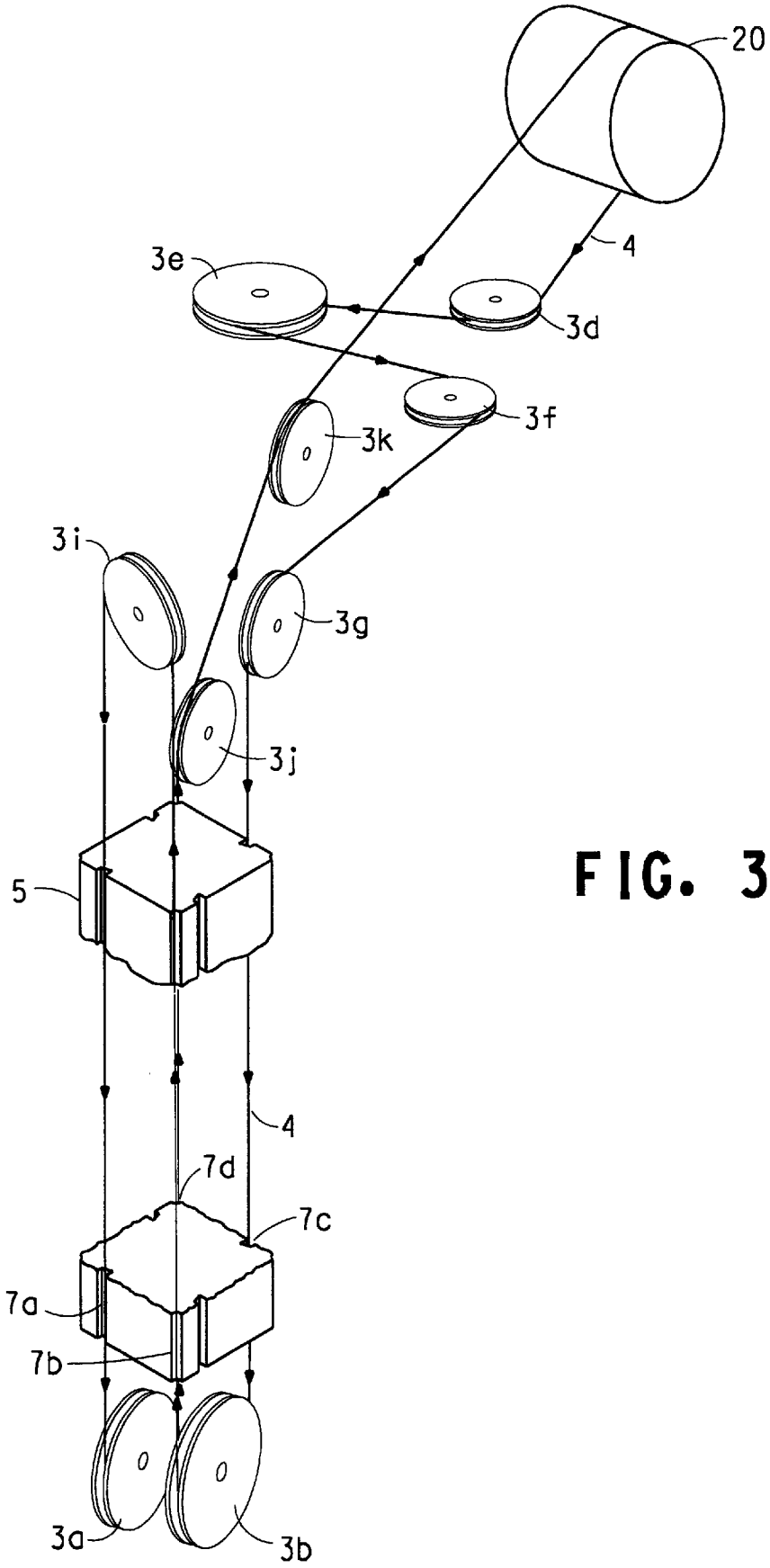
FIG. 3 is a diagram of the path of travel of one endless cable support.

FIG. 3 is a detailed diagram of the path of travel for one of the two endless cable supports. The endless cable support 4 is driven by a motorized pulley 20 and travels through a tensioning system of fixed pulleys 3*d* and 3*f* and a moveable pulley 3*e* which adjust automatically to maintain the set tension on the cable support 4. Cable 4 travels over pulley 3*g* which changes direction of the cable and aligns it in a groove 7*c* on the face of the mandrel 5. Pulley 3*b* reverses the direction of the cable 4 and maintains the alignment with grove 7*b* in the corner of the mandrel 5. Pulley 3*i* reverses direction of the cable and aligns the cable to travel in grooves 7*a* and 7*b* of the mandrel 5. Pulley 3*a* reverses the direction of the cable and aligns the cable to travel in the corner grove 7*d* of the mandrel 5 and then over alignment pulleys 3*j* and 3*k* back to the motorized pulley 20. A similar endless cable support, pulley system, path of travel and drive pulley (not shown) are used for a second endless support cable that runs in the opposite corners of the mandrel not covered by above cable 4. Both endless cables are synchronized to travel at identical rates and can be speed adjusted for various production rates. The population density of bristles of a bristle subassembly is set by controlling the wrapping mechanism rotational speed relative to the linear speed of the endless cables.

FIG. 4 shows the mandrel 5 detail in which the axis of pulleys 3*a* and 3*b* are offset from the axis of pulleys 3*c* and 3*d* (3*d* not shown) to prevent interference between the pulleys that carry the support cables. Groove 22 for the cutter is shown. The grooves in the corners of the mandrel are subject to wear and each corner has a replaceable corner plate 24. The corner plate is held in place by screws and can be replaced when worn excessively.

Figure 5:
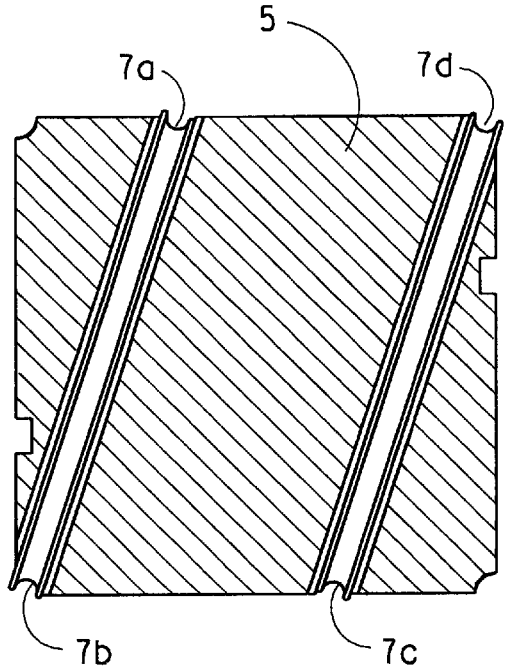
FIG. 5 is a mandrel detail at horizontal section 5—5.

FIG. 5 shows the mandrel detail horizontal section 5—5 which shows the recessed grooves 7*a* and 7*c* each on an opposite face of the mandrel 5 and the corner grooves 7*b* and 7*d* of the mandrel. Unmarked are the opposing corners and recessed grooves on the mandrel.

Figure 6:
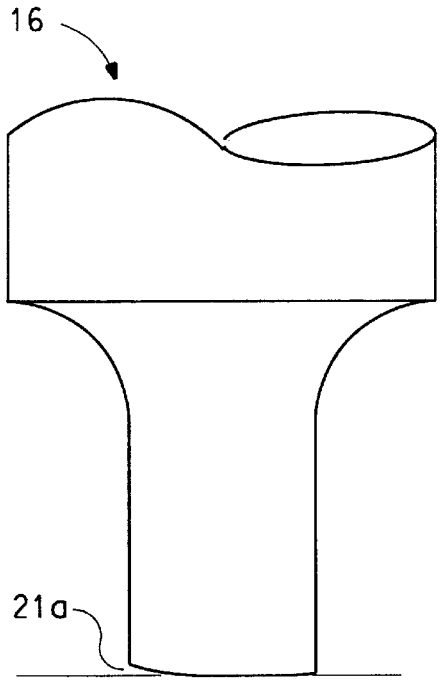
FIG. 6 is a side view of ultrasonic horn

FIG. 6 shows a side view of the ultrasonic horn 16 and shows the radius 21*a* which facilitates a smooth transition of the base string and the wrap under the ultrasonic horn. The horn is operated at a frequency of 20–70 kHz and preferably at 50 kHz. The vibration amplitude of the horn tip is in the range of 25–75 microns.

Figure 7:
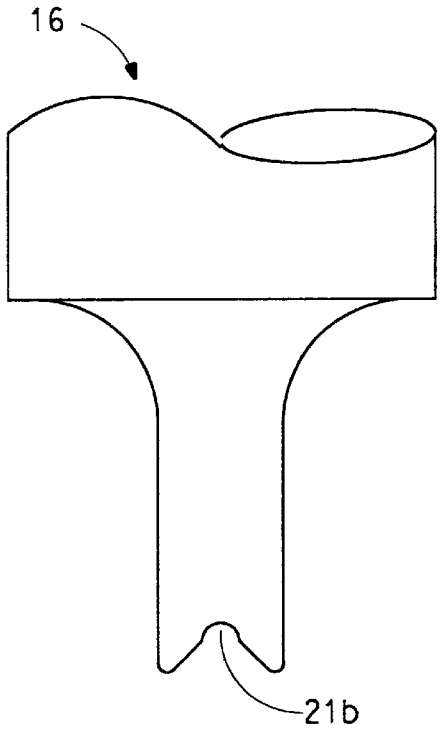
FIG. 7 is a front view of ultrasonic horn

FIG. 7 shows a front view of the ultrasonic horn 16 having a V shaped recess and a semicircular channel 21*b* at the apex of the V that is designed to self correct migration of a circular base string. As more clearly shown in FIG. 8, the spatial gap -a- between the filaments of the wrap 6 and each side leg of the horn V is less than the diameter -b- of the base string 8.

Figure 8:
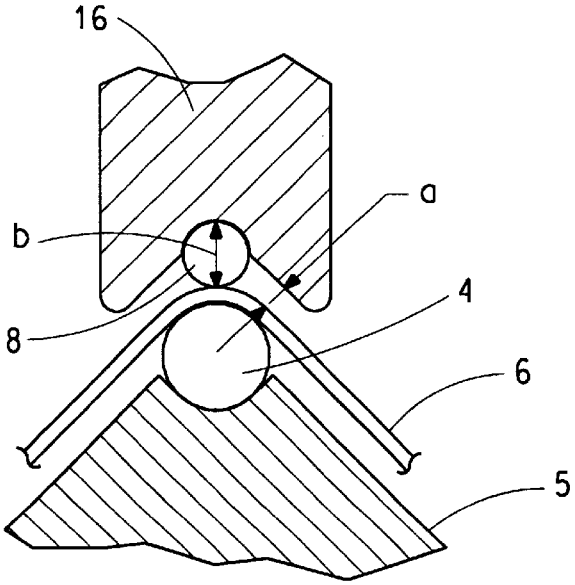
FIG. 8 is a cross section of ultrasonic horn holding base string in contact with wrap.

FIG. 8 shows a cross-section of the ultrasonic horn holding the base string 8 in contact with the filaments of wrap 6. The endless support cable 4 runs in the groove along the corner of the mandrel 5, the filaments of wrap 6 are carried by the cable 4 and the base string 8 is held in position by the recessed semicircular channel 21*b* of the V in the horn 16. The distance -b- which approximates the diameter of the base string is greater than the distance -a- between the side of the V in the horn and the filament of the wrap 6. This design prevents the migration of the base string 8 out of the semicircular channel 21*b* of the horn and keeps the base string in contact with the filament of the wrap during ultrasonic bonding of the base string and the filaments. FIG. 8 also illustrates the additional benefit of carrying the filaments of the wrap 6 on the cable 4 in that the cable provides a thermal sink for the wrap during bonding. The filaments of the wrap are protected from excessive heating and melting during the bonding step with the base string since the cable, particularly a metal cable, acts as a thermal sink to dissipate energy which would otherwise accumulate in the filaments of the wrap and thereby protects the integrity of the filaments of the wrap.

Figure 9:
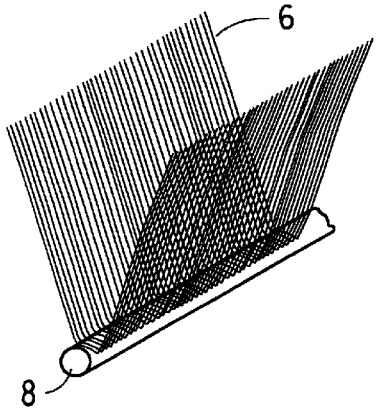
FIG. 9 is a perspective view of a typical bristle subassembly formed by the method of the invention.

FIG. 9 shows one of the many alternative bristle subassemblies after it has been made by the method of this invention. The base string 8 is bonded to the filaments of the wrap 6 which have been cut to form the bristles of the subassembly.

FIG. 10 shows a cross-section of a bristle subassembly having two base strings that can be made via the method shown in FIG. 1 except only two cutters are used on opposing sides of the mandrel.

FIG. 11 shows a cross-section of a bristle subassembly having two base strings on each side made via the method shown in FIG. 12.

In FIG. 12, the filaments of the wrap 6 are transported along the mandrel 5 by an endless support cable as shown in FIG. 1 Base strings 8*a* and 8*a*' are fed through guide tube 28*a* to predetermined positions on the face of the mandrel 5 as are base strings 8*b* and 8*b*' through guide tube 28*b*. The base strings 8*a* and 8*b* are shown just left of the center of each mandrel face, while base strings 8*a*' and 8*b*' are slightly to the right of the mandrel face center. The spacing between paired base strings, such as base strings 8*a* and 8*a*' is slightly more than the width of the cutter blade 10*a*. The base strings are passed under ultrasonic horn assemblies 27*a* and 27*b* each having a horn face with two properly spaced and sized semicircular channels for positioning each of the circular base strings and keeping them in contact with the filaments of the wrap. These base strings are ultrasonically bonded to the filaments of the wrap. Cutters 10*a* and 10*b* are positioned on the mandrel to cut the filaments of the wrap between each of the base strings to provide a bristle subassembly shown in FIG. 11. Cutters on the opposite sides of the mandrel (not shown) also cut the bonded filaments to provide four bristle subassemblies.

There are several alternative methods for making bristle subassemblies. Referring to FIG. 1, the base strings are omitted but care is taken when forming the wrap to provide a sufficient filament density so that the filaments of the wrap are tightly packed next to each other. The filaments of the wrap are bonded by the ultrasonic horn at the corner to form a bristle subassembly as shown in FIG. 9 except the base string 8 is not present.

In another alternative method, again referring to FIG. 1, the base string and the ultrasonic assembly are replaced by a polymeric bead which is extruded onto the wrap of filaments and bonds the filaments of the wrap to the polymeric bead. A bristle subassembly similar to the one shown in FIG. 9 will be formed except a polymer bead replaces the base string 8.

In still another alternative method, again referring to FIG. 1, the ultrasonic assembly is omitted and a solvent or an adhesive for the filaments is dispensed onto the wrap of filaments which bonds the filaments to the base string. A bristle subassembly similar to the one shown in FIG. 9 will be formed.

In still another alternative method, again referring to FIG. 1, the base string and the ultrasonic assembly are omitted and a solvent or an adhesive for the filaments is dispensed onto the wrap of filaments which bonds the filaments together. A bristle subassembly similar to the one shown in FIG. 9 will be formed except the base string 8 will not be present.

According to another aspect of the present invention, the apparatus and methodology described herein can be used with yarns, consisting of multiple micro-filaments, used as the wrap. Thus, a continuous supply of yarn or yarn-like material is wrapped around the mandrel in the same manner described above with respect to the monofilament wrap and bonded to the base string such as those described above. The function of the base string, which in prior devices helped to transport the monofilament wraps to the bonding stations, is not necessary when using the apparatus described herein.

The methodology for making tuft-strings from endless strands of yarn is similar to that used to make bristle subassemblies as described above. In particular, a continuous method for making a yarn tuft string includes the steps of (1) continuously forming a wrap of yarn by wrapping at least one yarn around the axis of at least a three sided mandrel having a moving cable support on each corner running substantially the length of the mandrel on the exterior corner of the mandrel capable of supporting and moving the yarn wrap along a substantial length of the mandrel;

(2) feeding at least one base string outside of the wrap of yarn to a selected portion of the mandrel as required to form the tuft string, such as the corner or side of the mandrel, while the wrap of yarn is being moved substantially the length of the mandrel;

(3) bonding the base string and the wrap of yarn together by simultaneously pressing the base string in contact with the wrap of yarn such that the yarn bundle is compressed and applying energy to the base string and the wrap of yarn; and (4) cutting the wrap of yarn at a point downstream of where the yarn is bonded with the base string to form at least one tuft string having at least one row of tufts connected to at least one base string.

The tuft-strings thus made can be used to make any of a variety of products, including carpeting and other floor coverings.

The yarn materials can be any of the known varieties in which hundred of individual filaments can be found in the cross-section of a single strand. The physical properties of the yarn materials are different from the aforementioned monofilament materials. Common examples of the yarn materials can be found in residential and commercial carpeting, while the monofilament material is used to make brush bristles, fishing line, racquet strings, etc. The manufacturing parameters of the machinery, including the feed rate of the continuous strand of material that comprises the "wraps" can be customized to match the material.

What is claimed is:

1. A continuous method for making a bristle subassembly comprising the steps of:

(a) continuously forming a wrap of polymeric filaments by wrapping at least one filament around the axis of at least a three sided mandrel having a moving cable support on each corner running the length of the mandrel on the exterior corner of the mandrel and returning along a continuous exposed recessed channel in a diagonal opposing face of the mandrel in an opposite direction, said cable support being capable of supporting and moving the polymeric filaments of the wrap along at least a portion of the length of the mandrel;

(b) feeding at least one base string outside of the wrap of polymeric filaments to a selected portion of the mandrel as required to form the subassembly while the polymeric filaments of the wrap are being moved at least a portion of the length of the mandrel;

(c) bonding the base string and the polymeric filaments of the wrap together by simultaneously pressing the base string in contact with the polymeric filaments of the wrap and applying energy to the base string and polymeric filaments of the wrap; and (d) cutting the polymeric filaments of the wrap at a point downstream of where the polymeric filaments of the wrap are bonded with the base string to form at least one bristle subassembly having at least one row of filament segments connected to at least one base string.

2. The method of claim 1 where the step of bonding the base string and polymeric filaments of the wrap together includes moving the base string and the polymeric filaments of the wrap under a wave energy source and applying sufficient wave energy to partially melt the base string, the polymeric filaments of the wrap or the base string and the polymeric filaments of the wrap.

3. The method of claim 2 where the wave energy source is an ultrasonic horn positioned adjacent to the mandrel and wherein the horn defines an opening sufficient to allow passage of the base string and the polymeric filaments of the wrap and maintains the base string in contact with the filaments of the wrap and does not allow the base string to reposition itself and is operated at frequency of 20–70 kHz.

4. The method of claim 1 wherein the step of continuously forming the wrap comprises feeding at least one polymeric filament into a wrapper and rotating the wrapper around the axis of the mandrel to form a wrap of polymeric filaments that are first brought into contact with a cable which is an endless cable and then with at least one base string.

5. The method of claim 4 wherein the base string is positioned on at least one corner of a four sided mandrel outside of the wrap of polymeric filaments and each endless cable support runs along one corner along the length of the mandrel protruding outward from the intersection of two side planes of the mandrel which form the corner of the mandrel and runs in an opposite direction in a recessed channel in the mandrel located on a diagonal side of the mandrel from said corner and does not protrude into the plane of the mandrel side.

6. The method of claim 4 wherein at least one base string is positioned on at least one side of a four sided mandrel outside of the wrap of polymeric filaments and each endless cable support runs along one corner along the length of the mandrel protruding outward from the intersection of two side planes of the mandrel which form the corner of the mandrel and runs in an opposite direction in a recessed channel in the mandrel located on a diagonal side of the mandrel from said corner and does not protrude into the plane of the mandrel side.

7. The method of claim 1 wherein the base string has a diameter of 50–5,000 microns and the polymeric filament of the wrap has a diameter of 12–5,000 microns.

8. The method of claim 7, wherein the base string comprises a bundle of monofilaments where at least one is thermoplastic polymer.

9. The method of claim 7 wherein the base string and the polymeric filament for forming the wrap are monofilaments and are of a thermoplastic polymer.

10. The method of claim 9 wherein the thermoplastic polymer is selected from the group consisting of aliphatic polyamides, aromatic polyamides, polyesters, polyolefins, polystyrenes, styrene copolymers, polyvinylchloride, fluoropolymers, polyurethanes and polyvinylidene chloride, and co-extrusions of any of the above polymers.

11. The method of claim 10 wherein the thermoplastic polymer is a polyamide.

12. The method of claim 11 in which the polyamide is selected from the group consisting of nylon 4, nylon 6, nylon 11, nylon 12, nylon 6,6, nylon 6,12, nylon 6,14, nylon 10, 10 and nylon 12,12 and co-extrusions of any of the above polymers.

13. The method of claim 12 in which the polyamide is nylon 6,12 (polyhexamethylene dodecanoamide).

14. The method of claim 10 in which the thermoplastic polymer is polybutylene terephthalate.

15. The method of claim 7 in which the polymeric filament for forming the wrap includes additives each in an amount of 0–50% by weight, based on the weight of the monofilament, selected from the group consisting of abrasives, colorants, colored particles, therapeutic agents, anti-microbial agents and mixtures thereof.

16. The method of claim 15 wherein the additive is an abrasive selected from the group consisting of oxides, carbides, silicates, nitrides, boronitrides, borides and metals.

17. The method of claim 7 in which the polymeric filament for forming the wrap includes 0.2–5.0% by weight, based on the weight of the polymeric filament, of light reflecting particles or film particles.

18. The continuous method of claim 1 for making a bristle subassembly comprising the steps of (a) continuously forming a wrap of polymeric filaments by wrapping at least one filament around the axis of a four sided mandrel having a moving endless cable support on each corner, said endless cable support runs along one corner along the length of the mandrel protruding outward from the intersection of the two side planes of the mandrel which form the corner of the mandrel and runs in an opposite direction in a continuous exposed recessed channel in the mandrel located on a diagonal side of the mandrel from said corner and does not protrude into the plane of the mandrel side and moves the wrap of polymeric filaments along a substantial length of the mandrel;

(b) feeding pairs of base strings of a polymeric monofilament outside of the wrap of polymeric filaments on each corner of the mandrel while the wraps are being moved substantially the length of the mandrel;

(c) bonding the base strings and the polymeric filaments of the wrap together by simultaneously pressing the base strings in contact with the polymeric filaments of the wrap and applying energy to the base strings and the polymeric filaments of the wrap; and (d) cutting the wrap at a point downstream of where the polymeric filaments of the wrap are bonded with the base strings to form bristle subassemblies each having at least one row of filament segments connected to at least one base string; and wherein in step (c) the bonding of the base strings and the polymeric filaments of the wrap together includes moving the base strings and the filaments of the wrap under a wave energy source which is an ultrasonic horn positioned adjacent to the mandrel that defines an opening sufficient to allow passage of the base string and the filaments of the wrap and maintains the base strings in contract with the filaments of the wrap and does not allow the base strings to reposition itself and sufficient wave energy is applied at a frequency of 20–70 kHz to partially melt at least one of the base strings and the filaments of the wrap.

19. The continuous method of claim 18, wherein the base strings and the polymeric filament of the wrap are polyamides.

20. A continuous method for making a bristle subassembly comprising the steps of (a) continuously forming a wrap of polymeric filaments by wrapping at least one filament around the axis of a four sided mandrel having a moving endless cable support on each corner, said endless cable support runs along one corner along the length of the mandrel protruding outward from the intersection of the two side planes of the mandrel which form the corner of the mandrel and runs in an opposite direction in a recessed channel in the mandrel located on a diagonal side of the mandrel from said corner and does not protrude into the plane of the mandrel side and moves the wrap of filaments along a substantial length of the mandrel;

(b) feeding pairs of base strings of a polymeric monofilament outside of the wrap of polymeric filaments onto each side of the mandrel while the wraps are being moved substantially the length of the mandrel;

(c) bonding the base strings and the polymeric filaments of the wrap together by simultaneously pressing the base strings in contact with the polymeric filaments of the wrap and applying energy to the base strings and polymeric filaments of the wrap; and (d) cutting the polymeric filaments of the wrap at a point downstream of where the filaments of the wrap are bonded with the base strings to form bristle subassemblies having at least one row of filament segments connected between two base strings, wherein in step (c) the bonding of the base strings and polymeric filaments of the wrap together includes moving the base strings and polymeric filaments of the wrap under a wave energy source which is an ultrasonic horn positioned adjacent to the mandrel and defines an opening sufficient to allow passage of the base strings and the filaments of the wrap and maintains the base strings in contact with the filaments of the wrap and does not allow the base strings to reposition itself and sufficient wave energy is applied to partially melt at least one of the base strings and the filaments of the wrap.

21. The continuous method of claim 20, wherein the polymeric filaments of the wrap and base strings are polyamides.

22. The method of claim 7 wherein the base string comprises a bundle of natural fibers.

23. The method of claim 22 wherein the bundle of natural fibers is selected from cotton, jute and hemp.

24. The method of claim 7 wherein the base string comprises a bundle of non-thermoplastic filaments.

25. The method of claim 24, wherein the non-thermoplastic filaments are fiberglass.

26. A continuous method for making a yarn string comprising the steps of (a) continuously forming a wrap of yarn by wrapping at least one yarn end around the axis of at least a three sided mandrel having a moving cable support on each corner running substantially the length of the mandrel on the exterior corner of the mandrel and returning along a continuous exposed recessed channel in a diagonal opposing face of the mandrel in an opposite direction, said cable support being capable of supporting and moving the wrap of yam along substantially the length of the mandrel;

(b) feeding at least one base string outside of the wrap of yarn to a selected portion of the mandrel as required to form the subassembly while the wrap of yarn is being moved substantially the length of the mandrel;

(c) bonding the base string and the wrap of yarn together by simultaneously pressing the base string in contact with the wrap of yarn such that the yarn bundle is compressed and applying energy to the base string and the wrap of yarn; and (d) cutting the wrap of yarn at a point downstream of where the wrap of yarn is bonded with the base string to form at least one bristle subassembly having at least one row of filament segments connected to at least one yarn string.

* * * * *